United States Patent [19]

Florack et al.

[11] Patent Number: 4,671,646

[45] Date of Patent: Jun. 9, 1987

[54] TONER MONITOR CONTROL MECHANISM

[75] Inventors: Christopher J. Florack, Rochester; William A. Resch, III, Pittsford, both of N.Y.

[73] Assignee: Eastman Kodak Company, Rochester, N.Y.

[21] Appl. No.: 826,046

[22] Filed: Feb. 4, 1986

[51] Int. Cl.[4] ..... G03G 15/08; G03G 15/01

[52] U.S. Cl. ..... 355/4; 355/3 DD; 355/14 D; 118/689

[58] Field of Search ..... 355/3 DD, 14 D, 4, 14 R; 118/688, 689

[56] References Cited

U.S. PATENT DOCUMENTS

| | | | |
|---|---|---|---|
| 3,754,821 | 8/1973 | Whited | 355/4 |
| 3,936,176 | 2/1976 | Whited | 355/4 |
| 4,351,604 | 9/1982 | Karasawa et al. | 355/4 |
| 4,447,145 | 5/1984 | Snelling et al. | 355/14 D |
| 4,452,174 | 6/1984 | Fedder | 118/689 |
| 4,536,080 | 8/1985 | Hauser et al. | 355/14 D |
| 4,550,254 | 10/1985 | Zomorrodi et al. | 355/3 DD X |
| 4,550,998 | 11/1985 | Nishikawa | 355/3 DD |

*Primary Examiner*—A. C. Prescott

*Attorney, Agent, or Firm*—Lawrence P. Kessler

[57] ABSTRACT

A control mechanism for a toner monitor used in an electrographic reproduction apparatus having interchangeable developer stations, respectively containing developer material of different colors, and in which the toner monitor measures reflectivity of the developer material and produces a signal corresponding to the measured reflectivity in order to enable regulation of toner concentration. The mechanism comprises a sensor, associated with a developer station located in the reproduction apparatus, for differentiating between at least two colors of toner and producing signals corresponding respectively to such colors. In response to the corresponding to a particular color, a signal is produced representative of the concentration of toner of that color. The signals respectively representative of toner concentration are substantially equal for like toner concentrations. Addtionally, the control mechanism may log certain events important to the operation of the reproduction apparatus utilizing interchangeable developer stations, and may control adjustment of the toner concentration signal based on certain parameters.

7 Claims, 3 Drawing Figures

TONER MONITOR CONTROL MECHANISM

BACKGROUND OF THE INVENTION

This invention relates in general to control mechanisms for use with toner monitors of electrographic reproduction apparatus, and more particularly to a toner monitor control mechanism for selectively adapting a reflective type toner monitor to effect regulation of the concentration of toners of a variety of colors and black.

In typical electrographic reproduction apparatus, it is common practice to modify a uniform charge on a dielectric member to form a latent electrostatic image corresponding to information to be reproduced. Such latent image is then developed by bringing it into contact with a developer material. Developer materials generally comprise a two-component mixture of granular carrier particles and pigmented or dyed resin-based electroscopic marking particles, referred to as toner, which triboelectrically adheres to the carrier particles. When the developer material contacts the latent electrostatic image on the dielectric member, the toner separates from the carrier particles and is deposited on the latent image in an imagewise configuration to form a developed image. Such developed image is thereafter transferred to receiver material and permanently fixed thereto, by heat and/or pressure for example, to form the copy of the information to be reproduced.

As will be readily appreciated, during such image development process, toner is continuously being depleted from the developer material. Since the density of the developed images being formed is directly related to the concentration (relative amount) of toner in the developer material, such concentration must be regulated within a given range in order to avoid an undesirable reduction in image density which would result in the production of unacceptable copies. One well known method for regulating toner concentration is to optically monitor the toner concentration and add toner to the developer material when the concentration drops to a preselected level below which unacceptable copies will be produced. An apparatus employing this method is described in U.S. Pat. No. 3,876,106 (issued Apr. 8, 1975 in the name of Powell et al). In such apparatus, light is directed at the developer material and the amount of light reflected therefrom is measured. The toner, which is usually black, is highly light absorbing and thus reflects substantially less light than the carrier particles. Accordingly, the reflectivity of the developer material (i.e., the amount of light reflected therefrom) depends upon the relative proportions of the components of the developer material. A processor, having a stored program, produces a signal in response to the amount of reflected light and in accordance with such program. The produced signal corresponds to the corresponding proportion of toner in the developer material (i.e., the toner concentration). This signal can then be used to activate a toner replenisher when the signal indicates that toner concentration is at a preselected minimum acceptable level.

It has recently been proposed to provide an electrographic reproduction apparatus with interchangeable developer stations respectively containing toner of different colors (e.g., red, green, blue, cyan, magenta, yellow or black). By interchanging such developer stations, copies may be selectively reproduced in different colors. Alternatively, copies may be reproduced containing multiple colors for the purpose of accenting or highlighting certain areas of the copies. The use of toners of different colors introduces a significant complexity in regulating toner concentration. Such complexity results from the fact that the different colors cause the toners to reflect light differently. For example, light colored toners are highly light reflective relative to carrier particles, as opposed to black toner which as noted above is highly light absorbing. Thus the reflectivity of the developer material containing light colored toner behaves substantially differently from developer material containing black toner.

SUMMARY OF THE INVENTION

This invention is directed to a control mechanism for a toner monitor used in an electrographic reproduction apparatus having interchangeable developer stations, respectively containing developer material of different colors, and in which the toner monitor measures reflectivity of the developer material and produces a signal corresponding to the measured reflectivity in order to enable regulation of toner concentration. Such mechanism controls the toner monitor output signal to selectively adapt such signal to effect regulation of the toner concentration of developer material in any one of the developer stations particularly located in the reproduction apparatus (i.e., irrespective of the color of the toner). The mechanism comprises a sensor for differentiating between at least two colors of toner respectively contained in a developer station located in the reproduction apparatus. The sensor produces signals respectively corresponding to such colors (usually one of the colors is black). In response to the reflectivity signal and a signal from the sensor corresponding to a particular one of such colors, a signal is produced representative of the concentration of toner of that particular color in the developer material. The signals respectively representative of toner concentration are substantially equal for like toner concentrations. Additionally, the control mechanism may log certain events important to the operation of the reproduction apparatus utilizing interchangeable developer stations, and may control adjustment of the toner concentration signal based on certain parameters.

The invention, and its objects and advantages, will become more apparent in the detailed description of the preferred embodiments presented below.

BRIEF DESCRIPTION OF THE DRAWINGS

In the detailed description of the preferred embodiments of the invention presented below, reference is made to the accompanying drawings, in which.

DESCRIPTION OF THE PREFERRED EMBODIMENTS

Figure 1:
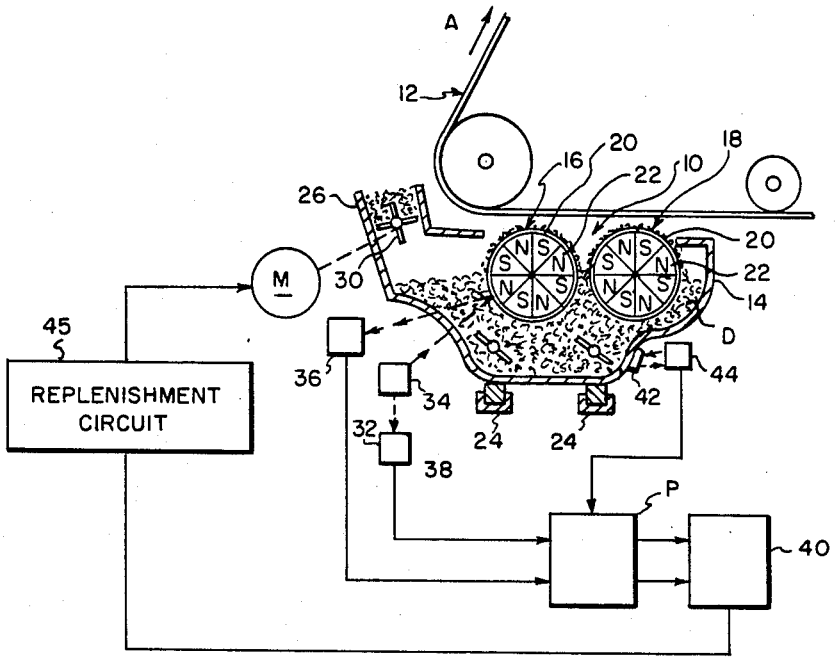
FIG. 1 is a schematic illustration of an interchangeable developer station for use in an electrographic reproduction apparatus, a monitor for measuring toner concentration within such station, and a control mechanism for such toner monitor according to this invention.

Referring now to the accompanying drawings, FIG. 1 shows a developer station, designated generally by the numeral 10, in operative association with an electrostatic image-carrying web 12 of a typical electrographic reproduction apparatus (details not shown). The developer station 10 is, for example, of the magnetic brush type such as shown and described in U.S. Pat. No. 3,543,720 (issued Dec. 1, 1970 in the name of Drexler et al). Such developer station includes a housing 14 providing a reservoir for developer material D. A pair of magnetic development brushes 16 and 18 are supported in the housing for applying developer material from the reservoir to the image bearing surface of the web 12 as the web moves in the direction of arrow A. The magnetic development brushes respectively include a rotatably mounted non-magnetic cylinder 20 having magnetic pole pieces 22 disposed in the interior of the cylinder in a fixed position along the longitudinal axis thereof. The housing 14 is supported on slides 24 so that the station 10 can be located in its operative association with the web 12 or readily removed from the reproduction apparatus for interchange with a similarly constructed station containing developer material of a different characteristic (i.e., color) as will be explained below.

The developer material D typical comprises a mixture of marking particles, referred to as toner, and carrier particles which adhere to each other under the influence of triboelectric forces. The carrier particles are fabricated from magnetically attractable material so as to be attracted to the surface of the cylinders 20 by the magnetic fields produced by the pole pieces 22 to form arrays which extend substantially radially from the cylinders in brush bristle like fashion. The toner is fabricated with pigments or dyes so that the toner is of a particular desired color. As the cylinders 20 rotate, developer material D on the peripheral surfaces of the cylinders is moved into contact with the surface of the web 12 bearing the electrostatic image. During such contact, toner is stripped from the carrier particles due to the electrostatic forces imparted by the image, and selectively adheres to the image for development thereof. The particular color of the developed image is determined by the color of the toner in the developer material in the station 10. In order to provide a particular color to the image to be developed, a developer station containing toner of the particular desired color is inserted in the reproduction apparatus into its operative association with web 12 by sliding the station on rails 24. To change such color, the developer stations are interchanged by sliding one station out of the reproduction apparatus and replacing it with an alternate station containing toner of the desired color.

Continuous rotation of the cylinders 20 cause the carrier particles from which toner has been stripped during image development to return to the main body of developer material in the reservoir of housing 14 where such particles are recoated with toner. Thus, as successive electrostatic images are developed, the proportion (i.e., concentration) of toner in the developer material gradually diminishes. Toner concentration is directly related to the density of the developed image; that is, as toner concentration decreases, developed image density diminishes. Therefore, it is necessary to periodically replenish the toner to maintain its concentration above a preselected limit to prevent the developed images from exhibiting an insufficient density level and thus being of an unacceptable quality. Of course the preselected limit may vary for each respective toner color.

A typical mechanism for replenishing toner to maintain its concentration level relative to carrier particles in the developer material includes a hopper 26 containing a supply of toner (of similar color to toner in the reservoir of housing 14). The hopper is connected to the housing 14 and defines an opening 28 communicating between the hopper and the housing reservoir. A paddle wheel 30, selectively rotatable by motor M, is located in the opening 28. Of course, the paddle wheel 30 may alternatively be a rotatable brush or soft fiberous roller. The paddle wheel normally blocks the flow of toner from the hopper 26 to the housing reservoir. However, rotation of the paddle wheel by the motor M allows a particular amount of toner to pass through the opening 28 to increase the toner concentration within the developer material contained in the reservoir.

The activation of the motor M to control toner replenishment is controlled in response to the concentration of toner in the developer material reaching a preselected minimum acceptable level. Measurement of toner concentration is accomplished by a monitor 32 such as shown for example in U.S. Pat. No. 3,876,106 (issued Apr. 8, 1975 in the name of Powell et al). The tonor monitor 32 utilizes the reflectance properties of the developer material as the basis for measuring toner concentration. Specifically, a light-emitting diode (LED) 34 is periodically energized and its light reflected off of the magnetic brush 16, for example at a point between where the brush nap emerges from the developer material in the reservoir and first contacts the web 12. The developer material at such point is characteristic of average toner concentration since it has not yet been subjected to localized depletion due to image development. The reflected light is received and processed by a signal processing circuit 36 to produce a first signal ($V_c$). Light from the LED 34 is also directly received by a signal processing circuit 38 to produce a second signal ($V_e$) which serves as a reference signal. The circuits 36 and 38 are shown for the sake of convenience in FIG. 1 as applying the produced signals directly into a programmable digital computer 40. In order to facilitate viewing, the digital computer 40 is shown as a dedicated structural component. However, the computer may be the main logic and control unit for the reproduction apparatus suitably programmed to carry out toner replenishment as described hereinbelow.

The computer 40 is programmed to determine toner concentration according to a control equation based on a comparison between the signals from the circuits 36 and 38. However, the reflectivity of toner in developer material varies depending upon the color of the toner. For example, the concentration of a light colored toner when compared to its reflectivity in developer material has an inverse relation to the concentration of black toner when compared to its reflectivity in developer material. That is, light colored toner is more reflective than carrier particles, and thus its reflectivity decreases as its concentration in the developer material decreases. On the other hand, black toner is less reflective than carrier particles, and thus its reflectivity increases as its concentration in the developer material decreases. Accordingly, the color of the particular toner in the developer material must be accounted for prior to the determination of toner concentration by the program for the computer 40. Therefore, the interchangeable developer stations respectively have a marking associated therewith representative of the color of the toner in its developer material. As shown in FIG. 1, the marking is an indicator 42 located on the housing 14 of the developer station. The indicator 42 is detected by a sensor 44 which produces an appropriate signal dependent upon the color of the toner in such station. Such signal is applied to a processor P which adapts the signals from circuits 36 and 38 to be applied to the computer 40 to enable a proper determination of toner concentration to be made. When the determined toner concentration falls to a preselected minimum acceptable level, the computer 40 activates a toner replenishment circuit 45 to turn on the motor M for rotation of the paddle wheel 30 whereby toner in the reservoir of housing 14 is replenished.

Figure 2:
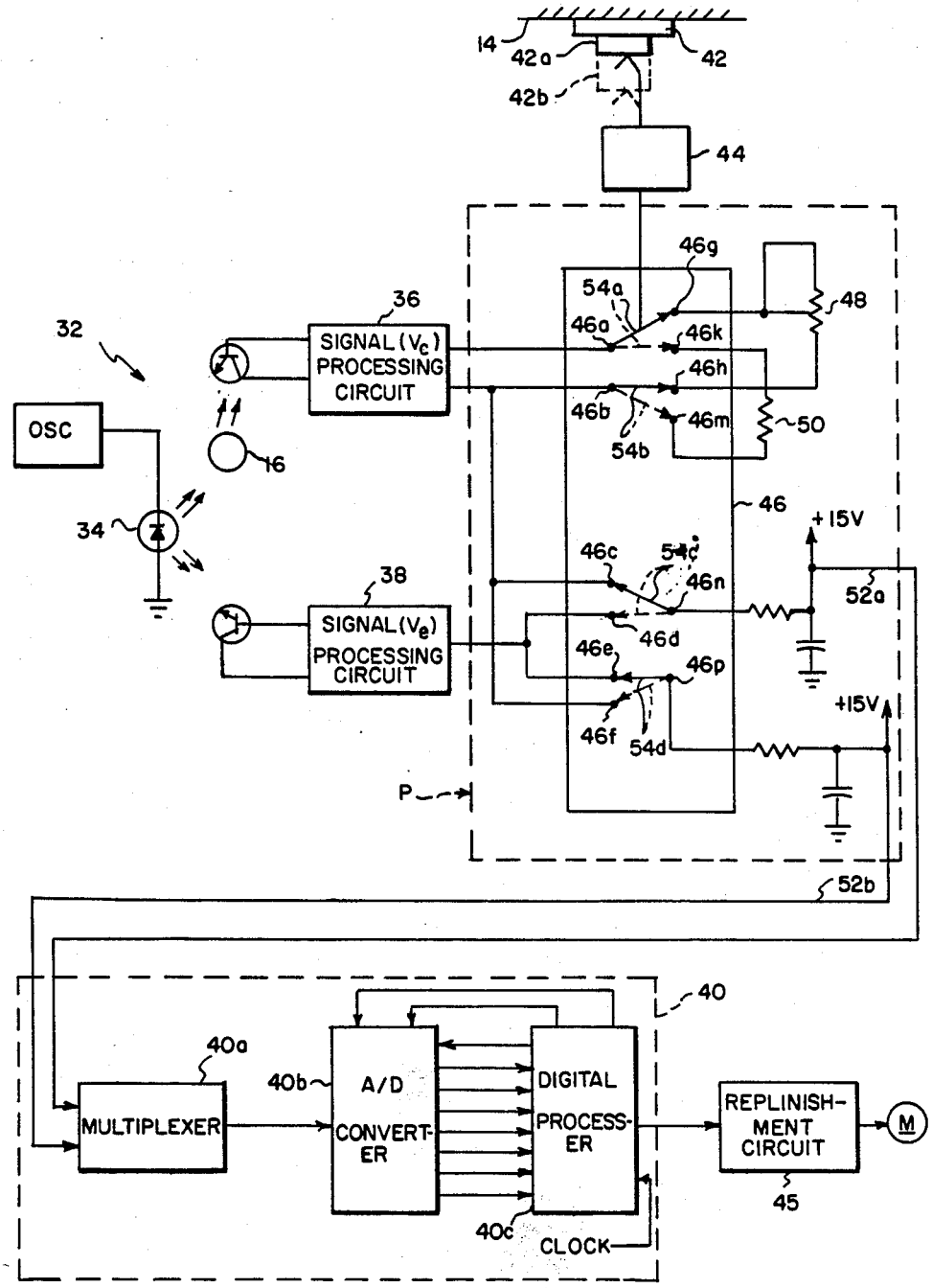
FIG. 2 is an electrical schematic and block diagram of the toner monitor and toner monitor control mechanism of FIG. 1.

FIG. 2 shows in somewhat greater detail how the signals from the toner monitor 32 and the indicator 42 are adapted by the processor P and applied to the computer 40. Lead lines 36*a*, 36*b*, 36*c* and 36*d* from signal processing circuit 36 are respectively coupled to terminals 46*a*, 46*b*, 46*c*, and 46*d* of a four pole/double throw switch 46. Lead lines 38*a* and 38*b* from signal processing circuit 38 are respectively coupled to terminals 46*e* and 46*f* of the switch 46. Terminals 46*g* and 46*h* of the switch 46 are coupled through a variable resistor 48, while terminals 46*k* and 46*m* are coupled through resistor 50. The variable resistor 48 sets the signal gain to a proper range for black toner while resistor 50 sets the signal gain to a usable (lesser) level for toner of a color other than black. Terminal 46*n* is connected through lead line 52*a* to the computer 40, while terminal 46*p* is connected to the computer through lead line 52*b*. The poles 54*a*, 54*b*, 54*c*, and 54*d* of the switch 46 are ganged so that in a first position (solid lines of FIG. 2) pole 54*a* connects terminals 46*a* and 46*g*, pole 54*b* connects terminals 46*b* and 46*h*, pole 54*c* connects terminals 46*c* and 46*h*, and pole 54*d* connects terminals 46*f* and 46*p*. In a second position (broken lines), pole 54*a* connects terminals 46*a* and 46*k*, pole 54*b* connects terminals 46*b* and 46*m*, pole 54*c* connects terminals 46*c* and 46*n*, and pole 54*d* connects terminals 46*d* and 46*p*.

Operation of the switch 46 to set its poles in the first or second position is accomplished by the sensor 44. For example, the sensor 44 mechanically detects a protrusion 42*a* or 42*b* (shown in broken lines in FIG. 2). The protrusions, which extended different distances from the housing 14 of a developer station serve to respectively indicate whether the station contains toner of one particular color (e.g. black) or toner of another color (e.g., other than black). Accordingly, when say black toner is in the developer station, protrusion 42*a* is detected by the sensor 44 and the switch 46 is set thereby in its first position. With the switch in such first position, the gain of the signal ($V_c$) from the signal processing circuit 36 indicating, as a voltage level, black toner reflectivity is set to an appropriate level, and such signal is applied to the computer 40 through lead line 52*a*; and, the signal ($V_e$) from the signal processing circuit 38 indicating, as a voltage level, the reference level of the LED 34 is applied to the computer 40 through lead line 52*b*. Alternatively, when say toner of a color other than black is in the developer station, protrusion 42*b* is detected by the sensor 44 and the switch 46 is set thereby in its second position. With the switch in such second position, the gain of the signal ($V_c$) from the circuit 36 indicating, as a voltage level, such other color toner reflectivity is set to an appropriate level, and such signal is applied to the computer 40 through lead line 52*b*; and, the signal ($V_e$) from the circuit 38 indicating, as a voltage level, the reference level of the LED 34 is applied to the computer 40 through the lead line 52*a*.

The computer 40 includes a multiplexer 40*a*, an anolog to digital (A/D) converter 40*b*, and a digital processor 40*c*. When the voltage level signals over lines 52*a* and 52*b* are applied to the multiplexer 40*a*, the multiplexer at appropriate times feeds its multiplexed output to the A/D converter 40*b* which in turn applies a corresponding digital word to the processor 40*c*. According to the concentration control program stored in the processor, the digital signal from line 52*a* is compared to the digital signal from line 52*b* which results in a determination of toner concentration. By switching the input of the signals from circuits 36 and 38 to the computer 40, the stored program in the processor 40*c* does not, in and of itself, have to account for the color of the toner in the developer station when determining toner concentration. That is, the comparison between the signal from line 52*a* with the signal from 52*b* is always made in the same way; however, for black toner such comparison is made of $V_c/V_e$ and for toner of a color other than black such comparison is made of $V_e/V_c$ due to the reversal of the input of the signals from circuits 36 and 38 to lines 52*a* and 52*b* by the switch 46. According to the stored program in the processor 40*c*, the determined toner concentration signal is continuously compared to a reference signal representative of the minimum acceptable concentration level. When toner concentration reaches such minimum acceptable level, the processor 40*c* produces a signal which is applied to the replenisher circuit 45 to turn on the motor M and effect toner replenishment as described above.

Figure 3:
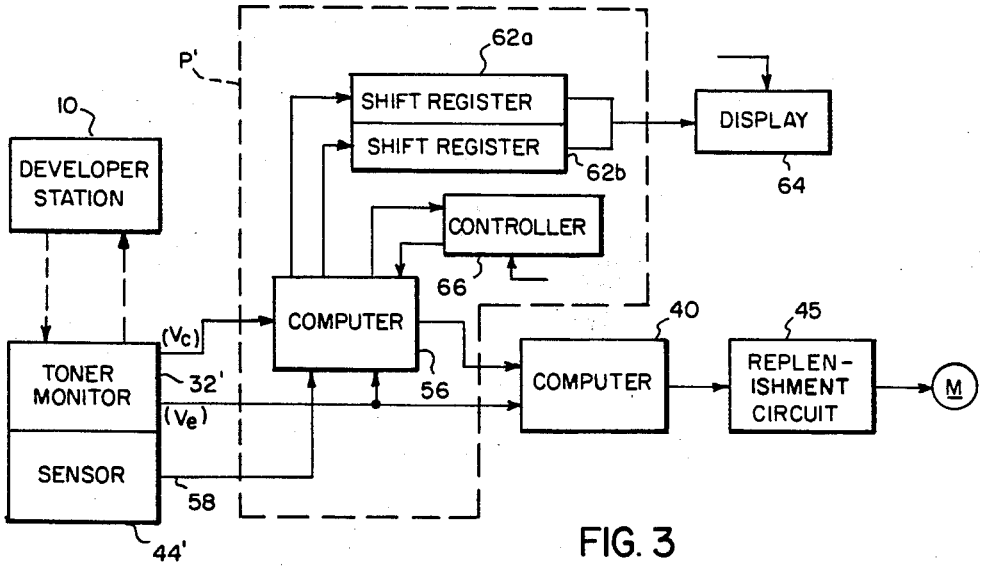
FIG. 3 is a schematic block diagram showing an alternate toner monitor control mechanism according to this invention.

The sensor 44 for operating the switch 46 can of course be of any other suitable type such as an electrical or optical sensor or a manually selectable mechanism. Further, the sensor and toner monitor could be integrally related as shown in the alternate embodiment of FIG. 3. The integrally related toner monitor 32' and sensor 44' are dedicated to a particular developer station; that is, a station containing toner of a particular color. Accordingly, the sensor 44' may be adapted to produce a signal representative of the particular toner color of the station with which it is associated. Such signal is applied to a computer 56 of a processor P' through lead line 58. The computer 56 also has signals $V_c$ and $V_e$ (from circuits 36 and 38) applied thereto. A program stored in the computer 56 utilizes the color signal to modify the signal $V_c$ according to the particular toner color and applies such modified signal to the computer 40. As a result, the stored program in the computer 40 does not have account for the color of the toner in the developer station when determining toner concentration. The use of the computer 56 has additional advantages in that it may be used to log certain events important to the operation of the reproduction apparatus utilizing the interchangeable developer stations and may be controlled to provide an adjustment of the signal $V_c$ based on certain parameters. Specifically, the computer 56 may communicate with a plurality of shift registers 62*a* and 62*b* which store counts of such events as, for example, the number of times a particular station is inserted into the reproduction apparatus and the number of copies made by a particular developer station. The shift registers are coupled to a visual display mechanism 64 which is selectively activated to enable such logged events to be viewed. Further, the computer 56 is coupled to a control circuit 66. The control circuit 66 alters the stored program in the computer 56 to provide an adjustment of signal $V_C$ based on, for example, drift of the toner monitor LED or the need to adjust toner concentration signal due to aging of the developer material in a particular developer station.

The invention has been described in detail with particular reference to preferred embodiments thereof, but it will be understood that variations and modifications can be effected within the spirit and scope of the invention.

We claim:

1. In an electrographic reproduction apparatus having interchangeable developer stations, respectively containing developer material including toner of different colors, and toner monitor means which measures reflectivity of the developer material and produces a signal corresponding to measured reflectivity for determining toner concentration to enable regulation of such concentration when such concentration is outside of preselected limits, a mechanism for controlling said toner monitor means to selectively adapt such means to enable regulation of the toner concentration of a particular developer station associated with said reproduction apparatus, said mechanism comprising:

means, operatively associated with a developer station when located in said reproduction apparatus, for differentiating between at least two colors of toner, said differentiating means producing signals respectively corresponding to such colors; and means, responsive to said signal representative of developer material reflectivity and a signal from said differentiating means corresponding to a particular color, for producing a signal representative of the concentration of toner of that color, wherein said signals respectively representative of toner concentration are equal for like toner concentrations.

2. The invention of claim 1 wherein said concentration signal producing means comprises a programmable digital computation means having a stored program, said computation means being responsive to said signal representative of developer material reflectivity and said signals from said differentiating means for producing said respective toner concentration signal in accordance with such stored program.

3. The invention of claim 2 wherein said computation means further includes means for altering such stored program in order to take into account changes in parameters relative to developer material within said developer stations.

4. The invention of claim 1 wherein said developer stations respectively include means for identifying toner of such station with regard to its color, and wherein said differentiating means includes sensor means operatively coupled to a developer station identifying means when such station is located in said reproduction apparatus, for identifying the toner color of such developer station.

5. The invention of claim 4 wherein said computation means further includes means for logging in the number of copies respectively made with toner from a particular developer station and selectively displaying such number.

6. The invention of claim 4 wherein said computation means further includes means for logging in the respective number of times said interchangeable developer station has been located in said reproduction apparatus.

7. The invention of claim 1 wherein said differentiating means comprises a switch having a first position representative of one toner color and a second position representative of a second toner color, and wherein said concentration signal producing means comprises circuit means operatively coupled to said switch and said toner monitor, for comparing said signal representative of developer material reflectivity from said converting means to a reference signal whereby when said switch is in its first position such comparison is made by dividing said digital signal by said reference signal and when in its second position such comparison is made by dividing said reference signal by said digital signal.

* * * * *